US010086997B2

(12) United States Patent
Shek

(10) Patent No.: US 10,086,997 B2
(45) Date of Patent: Oct. 2, 2018

(54) CUSHIONED GARBAGE CONTAINER

(71) Applicant: Michael Shek, San Mateo, CA (US)

(72) Inventor: Michael Shek, San Mateo, CA (US)

( * ) Notice: Subject to any disclaimer, the term of this patent is extended or adjusted under 35 U.S.C. 154(b) by 344 days.

(21) Appl. No.: 14/994,502

(22) Filed: Jan. 13, 2016

(65) Prior Publication Data

US 2017/0197786 A1 Jul. 13, 2017

(51) Int. Cl.

| | |
|---|---|
| ***B65D 43/26*** | (2006.01) |
| ***B65F 1/16*** | (2006.01) |
| ***B65F 1/06*** | (2006.01) |
| ***B65F 1/14*** | (2006.01) |

(52) U.S. Cl.

CPC ..... *B65F 1/163* (2013.01); *B65F 1/06* (2013.01); *B65F 1/1468* (2013.01); *B65F 1/1646* (2013.01); *B65F 2001/1661* (2013.01)

(58) Field of Classification Search

CPC .. B65F 1/63; B65F 2001/1661; B65F 1/1646; B65F 1/16; B65F 1/161

USPC ..... 220/264

See application file for complete search history.

(56) References Cited

U.S. PATENT DOCUMENTS 6,837,393 B1 * 1/2005 Kuo ..... B65F 1/1607 220/263
2004/0164077 A1 * 8/2004 Kuo ..... B65F 1/08 220/263
2010/0294769 A1 * 11/2010 Lee ..... B65F 1/163 220/263
2013/0105488 A1 * 5/2013 Quan ..... B65F 1/06 220/495.08

FOREIGN PATENT DOCUMENTS

| | | |
|---|---|---|
| TW | I252835 B | 4/2006 |
| TW | I293936 B | 3/2008 |
| TW | M431156 U | 6/2012 |

* cited by examiner

*Primary Examiner* — Andrew T Kirsch

*Assistant Examiner* — Don M Anderson

(74) *Attorney, Agent, or Firm* — Muncy, Geissler, Olds & Lowe, P.C.

(57) ABSTRACT

A cushioned garbage container includes a main body, a linkage mechanism and a cushion element. The main body has a barrel body and a cover body, the barrel body has a first block having a receiving portion and a second block, and the receiving portion has a receiving space and a positioning portion located in the receiving space. The linkage mechanism is disposed on the barrel body and is comovable with the cover body, the linkage mechanism has a stamping member, a propping rod connected to the stamping member, and a driving member disposed on the propping rod and located in the receiving space. The cushion element is detachably disposed in the receiving space, has a fixed portion having a positioning assembly and a movable portion, the positioning assembly is restrictedly engaged with the positioning portion, and the movable portion is engaged with the driving member.

8 Claims, 8 Drawing Sheets

CUSHIONED GARBAGE CONTAINER

BACKGROUND OF THE INVENTION

Field of the Invention

The present invention relates to a garbage container, and more particularly to a cushioned garbage container.

Description of the Prior Art

Usually, when using a conventional garbage container, a user needs to remove a cover body with hands before throwing garbage into the garbage container. In addition, when the user holds the garbage with both hands, s/he needs to put the garbage aside so as to remove the cover body. To resolve this inconvenience, a stamping garbage container as disclosed in TWM431156 is provided, and a cover body of the stamping garbage container can be lifted by stamping. However, when the user move his/her foot from the stamping garbage container, the cover body drops down quickly and makes noises. Therefore, a cushion element is further disposed on a garbage container so that the cover body can move slowly, such cushioned garbage containers with the cushion element are disclosed in TWI252835 and TWI293936.

It is to be noted that the cushion element moves frequently, so a service life is short, and the user needs to replace the cushion element regularly to maintain a preferable cushion function. However, in this type of cushioned garbage containers, the cushion element is mostly disposed in the garbage container; therefore, the user needs to disassemble many elements before replacing the cushion element. It is difficult, inconvenient and time-consuming for the user to replace the cushion element.

The present invention has arisen to mitigate and/or obviate the afore-described disadvantages.

SUMMARY OF THE INVENTION

The major object of the present invention is to provide a cushioned garbage container which can largely reduces the difficulty of a user replacing a cushion element, so the user can replace the cushion element immediately without disassembling other elements of the garbage container. In other words, it is convenient and time-saving for the user to replace the cushion element of the cushioned garbage container.

To achieve the above and other objects, a cushioned garbage container is provided, including a main body, a linkage mechanism and a cushion element. The main body has a barrel body and a cover body openably covering on the barrel body, a circumferential wall of the barrel body can be divided into a first block which is connected to the cover body and a second block which is opposite to the first block, the first block is formed with a receiving portion, and the receiving portion has a receiving space for communicating with outside and a positioning portion located in the receiving space. The linkage mechanism is disposed on the barrel body and is comovable with the cover body, the linkage mechanism has a stamping member for being stamped, a propping rod and a driving member, two ends of the stamping member are located on the first block and the second block respectively, the propping rod is disposed on the first block and passes through the receiving space, two ends of the propping rod are connected to the stamping member and the cover body respectively, and the driving member is disposed on the propping rod and located in the receiving space. The cushion element is detachably disposed in the receiving space, the cushion element has a fixed portion and a movable portion which is movable relative to the fixed portion, the fixed portion has a positioning assembly, the positioning assembly is restrictedly engaged with the positioning portion, and the movable portion is engaged with the driving member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
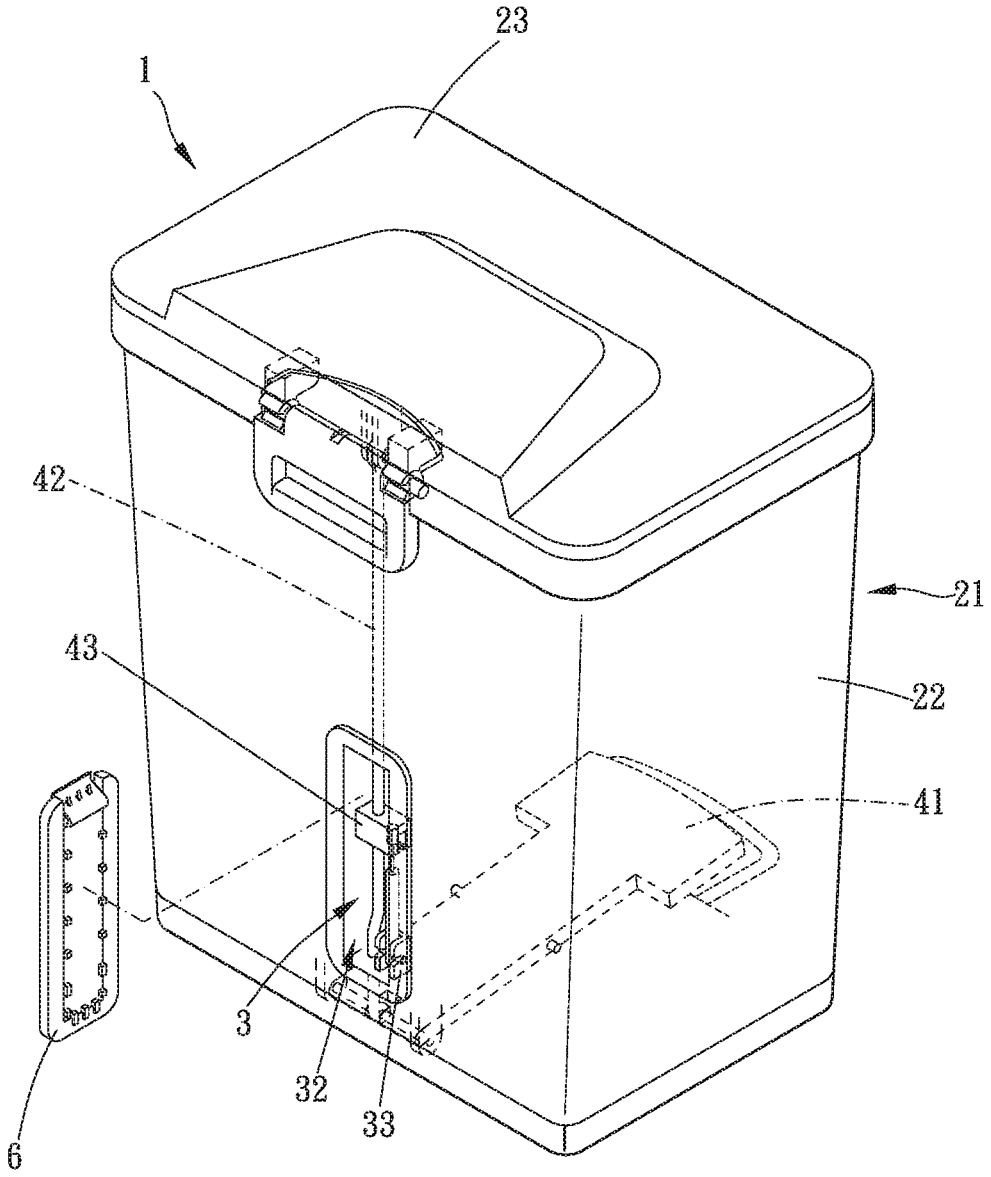
FIG. 1 is a sketch of a preferred embodiment of the present invention.
Figure 2:
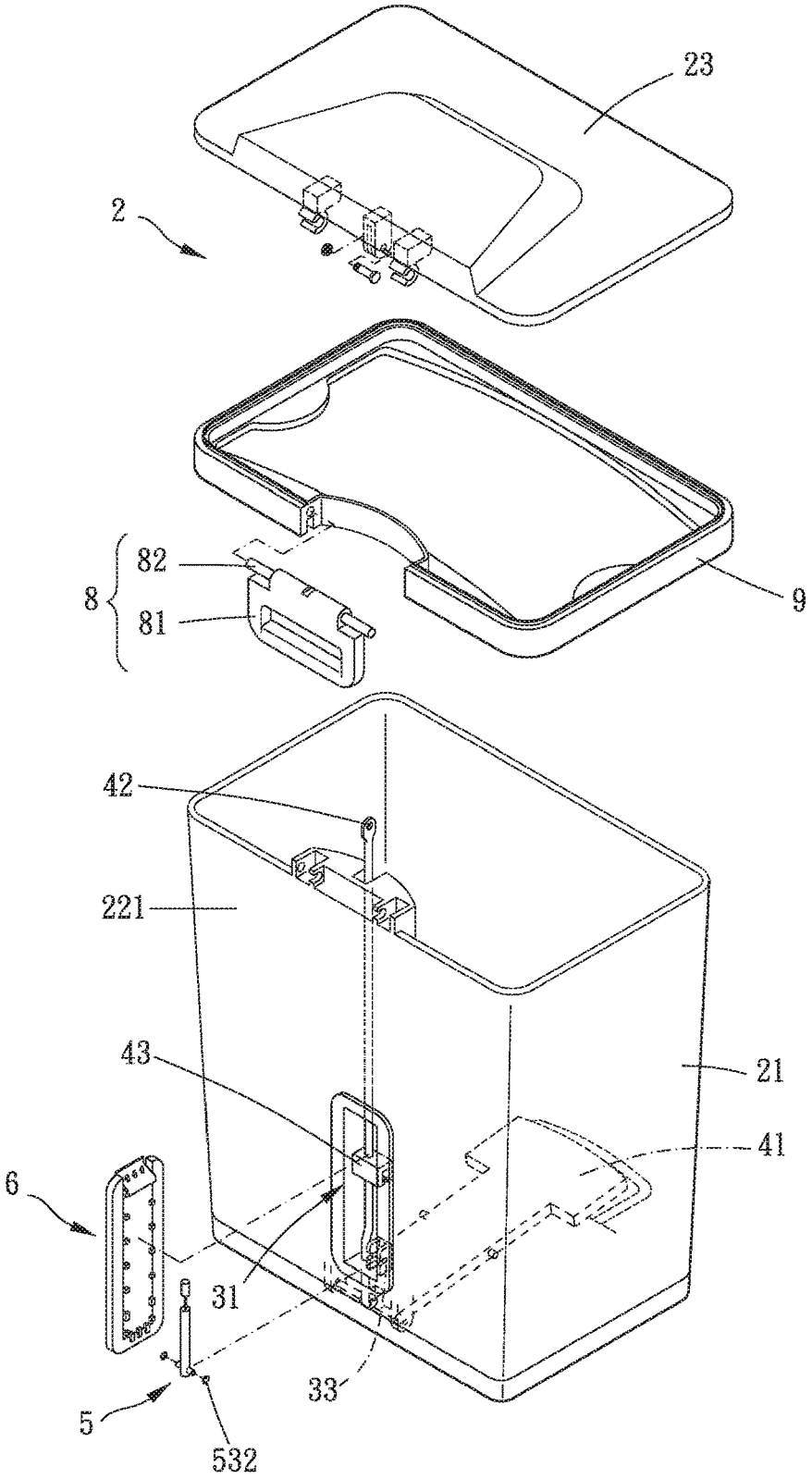
FIG. 2 is a breakdown drawing of the preferred embodiment of the present invention.
Figure 3:
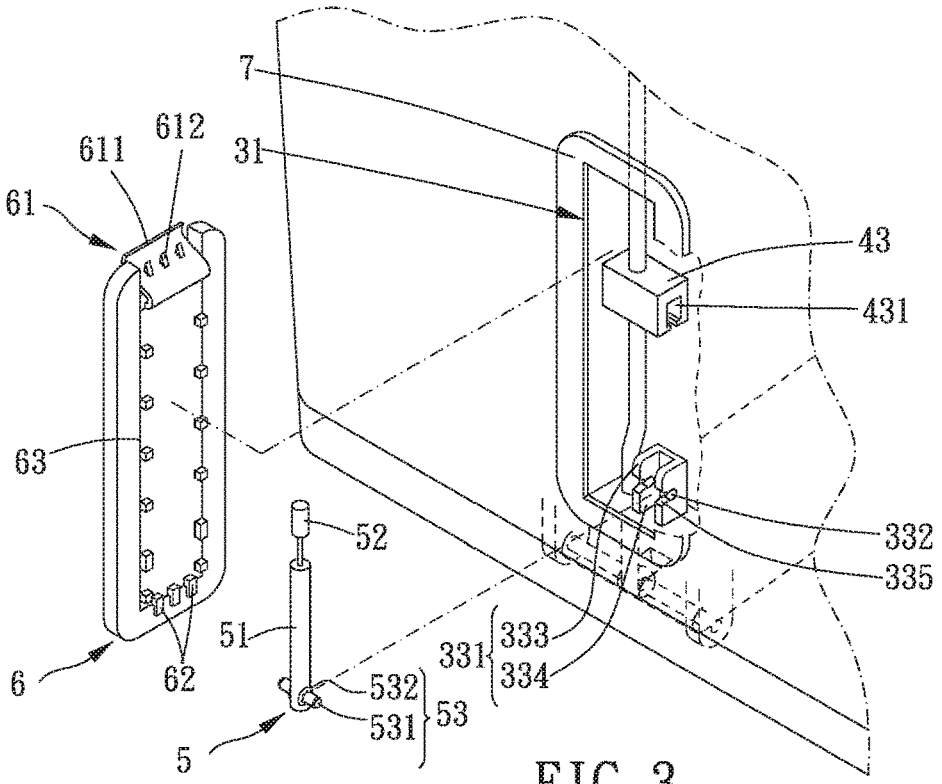
FIGS. 3 to 6 are drawings showing assembling of parts of the preferred embodiment of the present invention.
Figure 4:
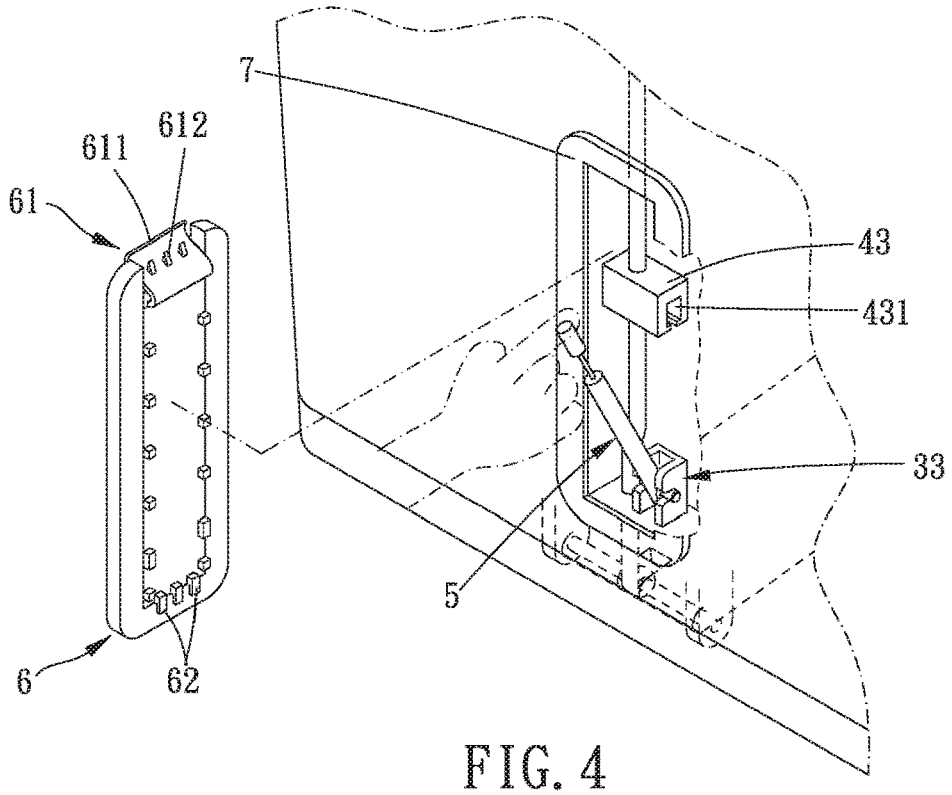
Figure 5:
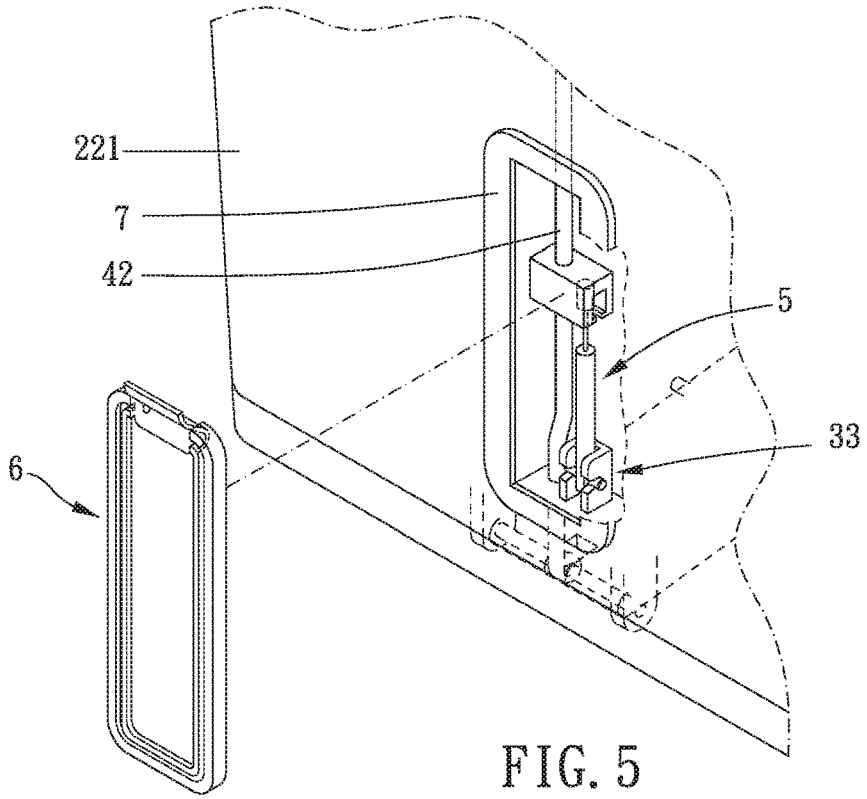
Figure 6:
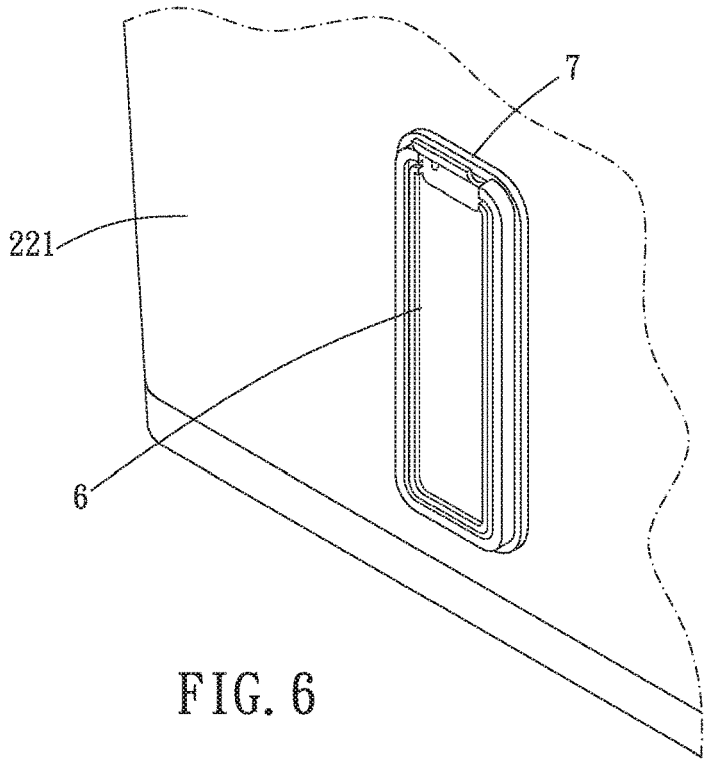
Figure 7:
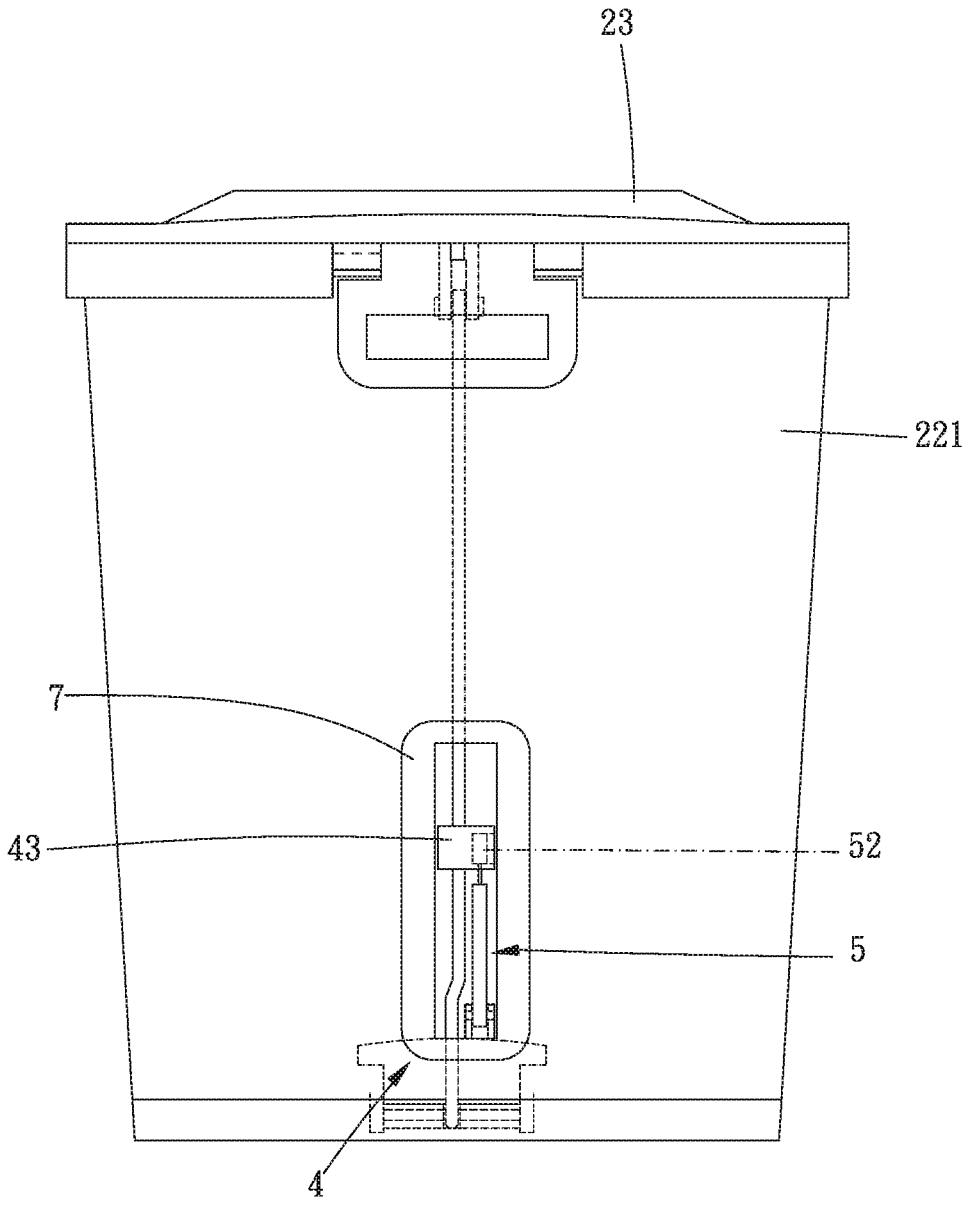
FIG. 7 is a rear elevational view of the preferred embodiment of the present invention out of use.
Figure 8:
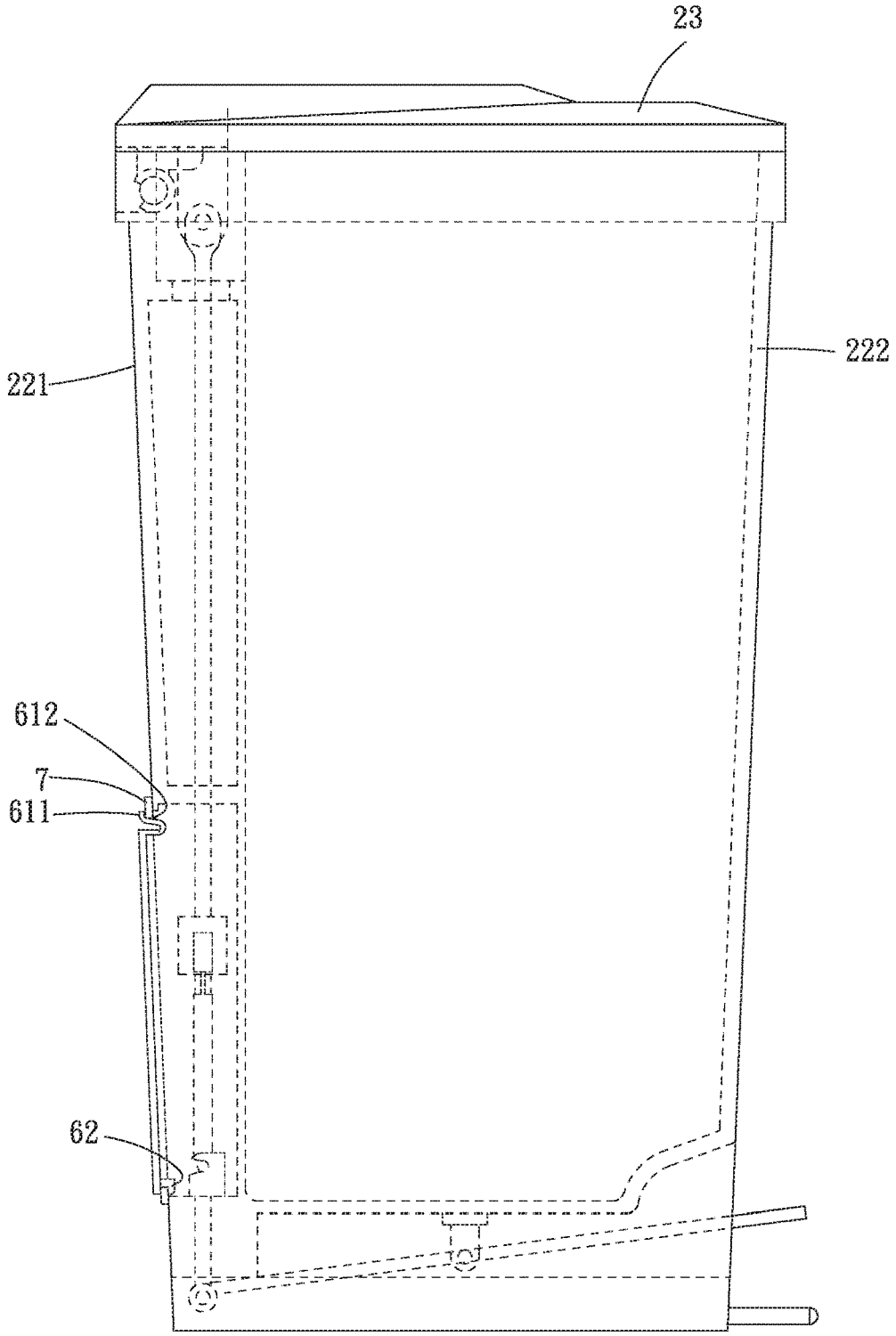
FIG. 8 is a side view of FIG. 7.
Figure 9:
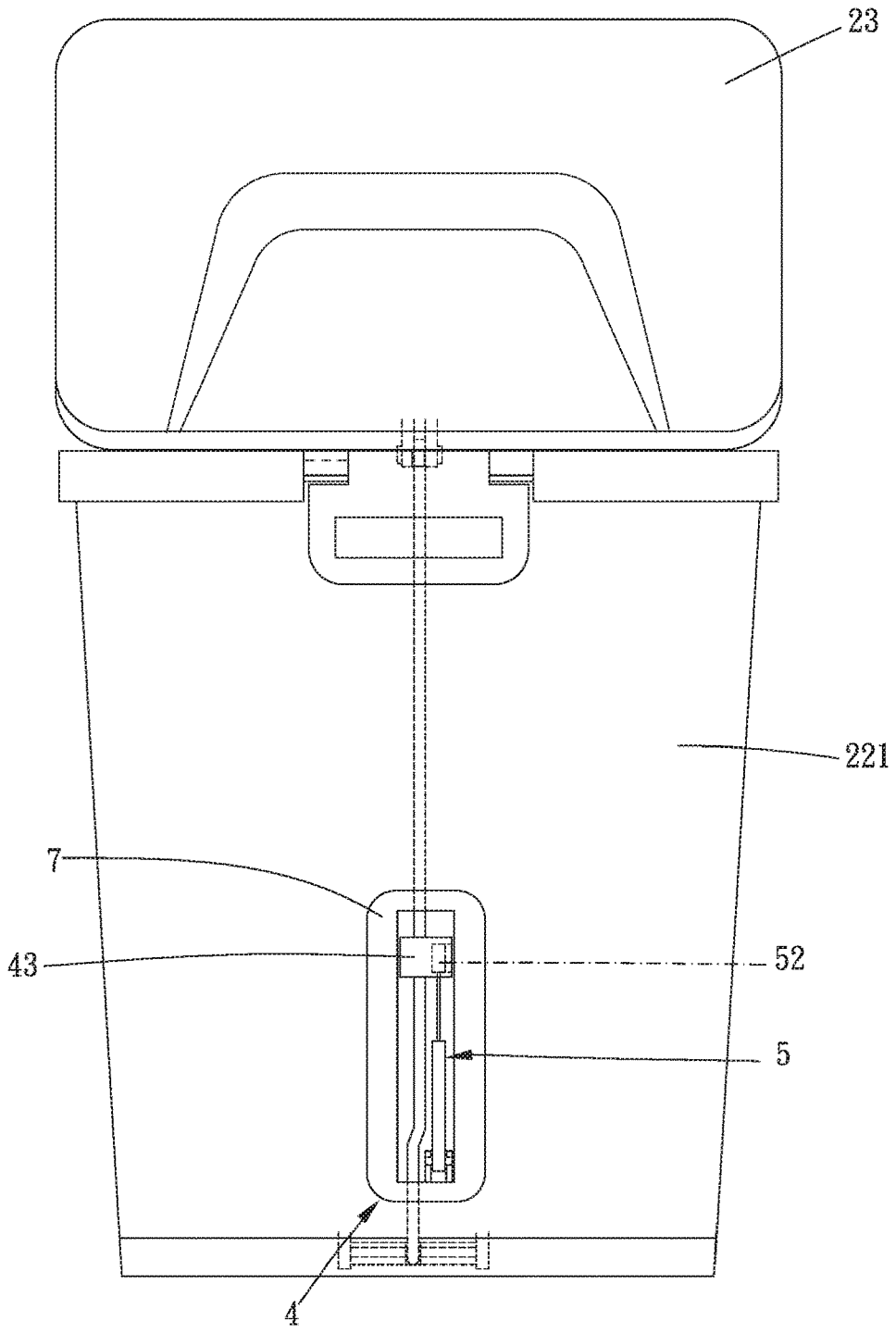
FIG. 9 is a rear elevational view of the preferred embodiment of the present invention in use.
Figure 10:
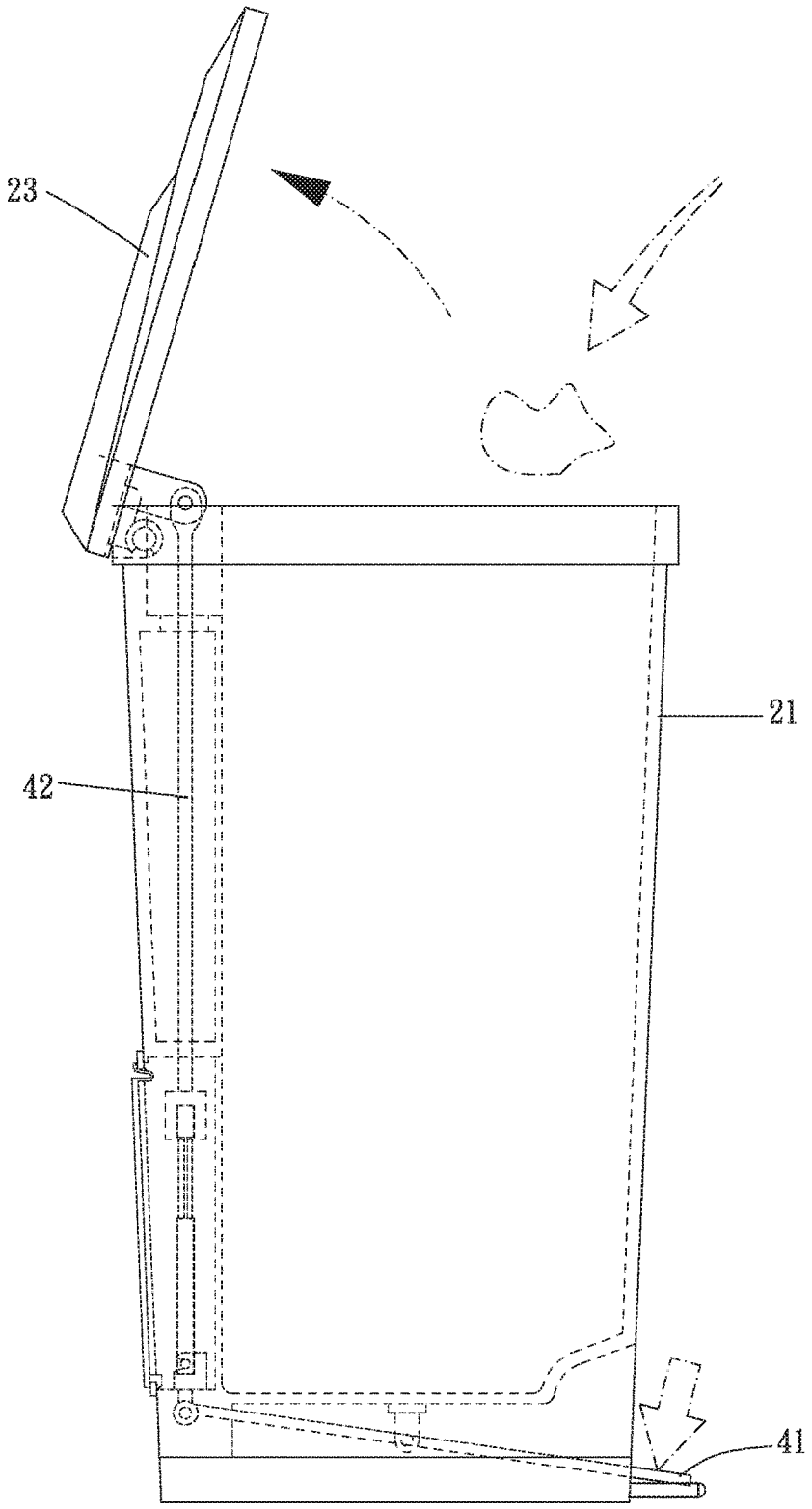
FIG. 10 is a side view of FIG. 9.

Please refer to FIGS. 1 to 10, for a preferred embodiment of the present invention. A cushioned garbage container 1 includes a main body 2, a linkage mechanism 4 and a cushion element 5.

The main body 2 has a barrel body 21 and a cover body 23 which openably covers on the barrel body 21, a circumferential wall 22 of the barrel body 21 can be divided into a first block 221 which is connected to the cover body 23 and a second block 222 which is opposite to the first block 221, the first block 221 is formed with a receiving portion 3, and the receiving portion 3 has a receiving space 32 for communicating with outside and a positioning portion 33 located in the receiving space 32.

In this embodiment, the barrel body 21 is substantially cuboid, and the receiving portion 3 is recessed on the circumferential wall 22 of the barrel body 21. The barrel body 21, the receiving portion 3 and the positioning portion 33 are integrally formed. Preferably, the main body 2 further includes a pivoting assembly 8, the pivoting assembly 8 has a gripping portion 81 and an axle 82 disposed through the gripping portion 81, and the cover body 23 is pivoted to the barrel body 21 via the axle 82. In addition, a user can grip the gripping portion 81 with just one hand to move the cushioned garbage container 1. More preferably, the main body 2 further includes a cushion member 9 which is sleeved on the barrel body 21, and the cushion member 9 is located between the cover body 23 and the barrel body 21. The user can clamp a garbage bag between the cushion member 9 and the barrel body 21 to fix the garbage bag so as to prevent the garbage bag from sliding down into the barrel body 21 due to a weight of the garbage bag. Furthermore, in other embodiments, if a side of the cushion member 9 facing the cover body 23 is covered with an elastic layer, the cushion member 9 can reduce a volume of a noise that the cover body 23 makes due to collision.

It is understandable that the linkage mechanism 4 is disposed on the barrel body 21 and is comovable with the cover body 23, the linkage mechanism 4 has a stamping member 41 for being stamped, a propping rod 42 and a driving member 43, two ends of the stamping member 41 are located on the first block 221 and the second block 222 respectively, the propping rod 42 is disposed on the first block 221 and passes through the receiving space 32, two ends of the propping rod 42 are connected to the stamping member 41 and the cover body 23 respectively, and the driving member 43 is disposed on the propping rod 42 and located in the receiving space 32.

The cushion element 5 which is used to cushion a speed of the cover body 23 covering on the barrel body 21 is detachably disposed in the receiving space 32, and the receiving space 32 communicates with the outside directly; therefore, when the cushioned element 5 needs to be replaced, the user can replace the cushion element 5 directly without disassembling other elements. In other words, it is time-saving for the user to replace the cushion element 5. The cushion element 5 has a fixed portion 51 and a movable portion 52 which is movable relative to the fixed portion 51, the fixed portion 51 has a positioning assembly 53, the positioning assembly 53 is restrictedly engaged with the positioning portion 33, and the movable portion 52 is engaged with the driving member 43. When the propping rod 42 moves up/down, the driving member 43 drives the movable portion 52 to move up/down synchronously.

In this embodiment, the driving member 43 is formed with a connecting opening 431 for receiving the movable portion 52, the connecting opening 431 is substantially complementary to the movable portion 52 in contour, and through engagement, the movable portion 52 can quickly be engaged with or disengaged from the driving member 43. In addition, as viewed from a direction facing an opening of the connecting opening 431, the connecting opening 431 is substantially inverted T-shaped, and an opening direction of the connecting opening 431 is perpendicular to an opening direction of the receiving portion 3. Similarly, the positioning assembly 53 and the positioning portion 33 are restrictedly engaged with each other so that the positioning assembly 53 and the positioning portion 33 can be assembled/disassembled quickly. Specifically, the positioning portion 33 is formed with two hooking members 331, each said hooking member 331 has a hook opening 332 which is tapered, the positioning assembly 53 includes two positioning members 531 opposite to each other, and the two positioning members 531 are arranged within the two hook openings 332 respectively to be restrictedly engaged with the two hooking members 331 respectively. An opening direction of each said hook opening 332 is substantially perpendicular to the opening direction of the connecting opening 431, and the cushion element 5 can be stably engaged with the driving member 43 and the positioning portion 33 respectively; therefore, when the cushion element 5 receives a force, the cushion element 5 will not fall off easily.

More specifically, each said hooking member 331 is further formed with a hook body 333 and a seat 334, an end of the seat 334 is fixed on an inner wall of the receiving portion 3, the other end of the seat 334 is connected with the hook body 333 and has an inclined face 335, the inclined face 335 and the hook body 333 define the hook opening 332, and the positioning member 531 can move along the inclined face 335 into the hook opening 332 smoothly. Preferably, the positioning assembly 53 is further provided with two sleeve members 532, the two positioning members 531 are disposed through the two sleeve members 532 respectively, and when the two positioning members 531 are restrictedly engaged with the two hooking members 331 respectively, each said sleeve member 532 is located between the fixed portion 51 and one said hooking member 331 so as to fill up a gap between the fixed portion 51 and each said hooking member 331 to improve the combination thereof.

It is to be noted that in order to prevent dirt or other objects from entering the receiving space 32 to cause the linkage mechanism 4 to function unsmoothly, or prevent objects from colliding with the cushion element 5 directly; the cushioned garbage container 1 is preferably further provided with a cover member 6 covering on the receiving portion 3, and the cover member 6 is for blocking a communication between the receiving space 32 and the outside. Specifically, the receiving portion 3 is further formed with a flange 31, and an engaging member 7 is disposed around the flange 31 and engaged with the cover member 6, the cover member 6 includes a base 63, a controlling portion 61 and at least one abutting portion 62, the controlling portion 61 and the at least one abutting portion 62 are disposed on two opposite ends of the base 63 respectively, the controlling portion 61 has a pressing portion 611 and at least one clamping portion 612, and when the cover member 6 is engaged with the engaging member 7, the pressing portion 611 and each said clamping portion 612 clamp a part of the engaging member 7, and each said abutting portion 62 and the engaging member 7 abut against and engaged with each other.

In this embodiment, the cover body 6 has three said abutting portions 62, the pressing portion 611 has three said clamping portions 612, and the base 63 is substantially rectangular. The controlling portion 61 is disposed on a width side of the base 63, as viewed from a direction facing a length side of the base 63, the controlling portion 61 is substantially V-shaped, and on a length direction of the base 63, the controlling portion 61 protrudes beyond the base 63. Preferably, the base 63, the three abutting portions 62 and the three clamping portions 612 are integrally formed. More preferably, each said clamping portion 612 is substantially wedge-shaped, when the cover body 6 is engaged with the receiving portion 3, an inclined portion of each said clamping portion 612 faces the propping rod 42 so that each said clamping portion 612 can pass through the engaging member 7 smoothly.

Given the above, the cushioned garbage container has the receiving portion which communicates with the outside directly, and the cushion element is disposed in the receiving portion to be engaged with the propping rod; therefore, when the user wants to replace the cushion element, s/he can replace the cushion element directly without disassembling other elements of the garbage container. In other words, it is convenient and time-saving for the user to assemble/disassemble the cushioned garbage container.

While we have shown and described various embodiments in accordance with the present invention, it should be clear to those skilled in the art that further embodiments may be made without departing from the scope of the present invention.

What is claimed is:

1. A cushioned garbage container, including:

a main body, having a barrel body and a cover body openably covering on the barrel body, a circumferential wall of the barrel body divided into a first block connected to the cover body and a second block opposite to the first block, the first block formed with a receiving portion, the receiving portion having a receiving space for communicating with outside directly and a positioning portion located in the receiving space;

a linkage mechanism, disposed on the barrel body and being comovable with the cover body, the linkage mechanism having a stamping member for being stamped, a propping rod and a driving member, two ends of the stamping member respectively located on the first block and the second block, the propping rod is disposed on the first block and passing through the receiving space, two ends of the propping rod respectively connected to the stamping member and the cover body, the driving member being disposed on the propping rod and located in the receiving space;

a cushion element, detachably arranged in the receiving space, the cushion element having a fixed portion and a movable portion movable relative to the fixed portion, the fixed portion having a positioning assembly, the positioning assembly being restrictedly engaged with the positioning portion, the movable portion being engaged with the driving member;

wherein the positioning portion has two hooking members, each hooking member is formed with a hook opening which is tapered, the positioning assembly includes two positioning members opposite to each other, and the two positioning members are respectively arranged within the two hook openings to be restrictedly engaged with the two hooking members.

2. The cushioned garbage container of claim 1, wherein each said hooking member is further formed with a hook body and a seat, an end of the seat is fixed on an inner wall of the receiving portion, the other end of the seat is connected with the hook body and has an inclined face, and the inclined face and the hook body define the hook opening.

3. The cushioned garbage container of claim 1, wherein the positioning assembly is further provided with two sleeve members, the two positioning members are disposed through the two sleeve members respectively, and when the two positioning members are restrictedly engaged with the two hooking members respectively, each said sleeve member is located between the fixed portion and one said hooking member.

4. The cushioned garbage container of claim 1, wherein the driving member is formed with a connecting opening, and the connecting opening is substantially complementary to the movable portion in contour.

5. The cushioned garbage container of claim 1, wherein the main body further includes a pivoting assembly, the pivoting assembly has a gripping portion and an axle disposed through the gripping portion, and the cover body is pivoted to the barrel body via the axle.

6. A cushioned garbage container, including:

a main body, having a barrel body and a cover body openably covering on the barrel body, a circumferential wall of the barrel body divided into a first block connected to the cover body and a second block opposite to the first block, the first block formed with a receiving portion, the receiving portion having a receiving space for communicating with outside directly and a positioning portion located in the receiving space;

a linkage mechanism, disposed on the barrel body and being comovable with the cover body, the linkage mechanism having a stamping member for being stamped, a propping rod and a driving member, two ends of the stamping member respectively located on the first block and the second block, the propping rod is disposed on the first block and passing through the receiving space, two ends of the propping rod respectively connected to the stamping member and the cover body, the driving member being disposed on the propping rod and located in the receiving space;

a cushion element, detachably arranged in the receiving space, the cushion element having a fixed portion and a movable portion movable relative to the fixed portion, the fixed portion having a positioning assembly, the positioning assembly being restrictedly engaged with the positioning portion, the movable portion being engaged with the driving member; and a cover member covering on the receiving portion, the cover member being for blocking a communication between the receiving space and the outside.

7. The cushioned garbage container of claim 6, wherein the receiving portion is further formed with a flange, an engaging member is disposed around the flange and engaged with the cover member, the cover member includes a base, a controlling portion and at least one abutting portion, the controlling portion and the at least one abutting portion are disposed on two opposite ends of the base respectively, the controlling portion has a pressing portion and at least one clamping portion, and when the cover member is engaged with the engaging member, the pressing portion and each said clamping portion clamp a part of the engaging member, and each said abutting portion and the engaging member abut against and engaged with each other.

8. The cushioned garbage container of claim 7, wherein the main body further includes a cushion member sleeved on the barrel body, the cushion member is disposed between the cover body and the barrel body; the barrel body is substantially cuboid; the receiving portion is recessed on the circumferential wall of the barrel body; the base is substantially rectangular, the controlling portion is disposed on a width side of the base, as viewed from a direction facing a length side of the base, the controlling portion is substantially V-shaped, and on a length direction of the base, the controlling portion protrudes beyond the base, the pressing portion is formed with three said clamping portions; the cover member is formed with three said abutting portions; the barrel body, the receiving portion and the positioning portion are integrally formed; the base, the three abutting portions and the three clamping portions are integrally formed; each said clamping portion is substantially wedge-shaped, when the cover body is engaged with the receiving portion, an inclined portion of each said clamping portion faces the propping rod; the positioning portion is provided with two hooking members, each said hooking member is formed with a hook opening which is tapered, the positioning assembly includes two positioning members opposite to each other, and the two positioning members are respectively arranged within the two hook openings to be restrictedly engaged with the two hooking members; an opening direction of each said hook opening is substantially perpendicular to an opening direction of the connecting opening; each said hooking member is further formed with a hook body and a seat, an end of the seat is fixed on an inner wall of the receiving portion, the other end of the seat is connected with the hook body and has an inclined face, the inclined face and the hook body define the hook opening; the positioning assembly is further provided two sleeve members, the two positioning members are disposed through the two sleeve members respectively, when the two positioning members are restrictedly engaged with the two hooking members respectively, each said sleeve member is located between the fixed portion and one said hooking member; the driving member is formed with a connecting opening for receiving the movable portion, the connecting opening is substantially complementary to the movable portion in contour, as viewed from a direction facing the opening of the connecting opening, the connecting opening is substantially inverted T-shaped, and the opening direction of the connecting opening is perpendicular to an opening direction of the receiving portion; and the main body further includes a pivoting assembly, the pivoting assembly has a gripping portion and an axle disposed through the gripping portion, and the cover body is pivoted to the barrel body via the axle.

* * * * *